US006811076B1

(12) United States Patent
Engberg

(10) Patent No.: US 6,811,076 B1
(45) Date of Patent: Nov. 2, 2004

(54) MAILBOX

(75) Inventor: Thomas James Engberg, West Burlington, IA (US)

(73) Assignee: Safety View, Inc., Burlington, IA (US)

( * ) Notice: Subject to any disclaimer, the term of this patent is extended or adjusted under 35 U.S.C. 154(b) by 0 days.

(21) Appl. No.: 10/434,996

(22) Filed: May 9, 2003

Related U.S. Application Data

(60) Provisional application No. 60/381,050, filed on May 17, 2002.

(51) Int. Cl.[7] ..... B65D 91/00
(52) U.S. Cl. ..... 232/38; 232/45
(58) Field of Search ..... 232/38, 17, 45; D99/29–33; 220/845

(56) References Cited

U.S. PATENT DOCUMENTS

| | | | | | |
|---|---|---|---|---|---|
| 1,616,269 | A | * | 2/1927 | Lodge | 40/566 |
| 2,561,007 | A | | 7/1951 | Bierig | |
| 3,107,848 | A | | 10/1963 | Penta | |
| 4,176,610 | A | * | 12/1979 | Markham et al. | 109/59 R |
| 4,244,512 | A | | 1/1981 | Wise | |
| 4,275,829 | A | * | 6/1981 | Johnson et al. | 232/17 |
| 4,650,113 | A | | 3/1987 | Hunt | |
| 5,056,711 | A | | 10/1991 | Bush | |
| D332,166 | S | * | 12/1992 | Williams | D99/29 |
| 5,178,320 | A | * | 1/1993 | Bertone | 232/17 |
| D354,611 | S | * | 1/1995 | Hazlett | D99/30 |
| 6,474,543 | B2 | | 11/2002 | Grell | |
| D471,691 | S | | 3/2003 | Ducolon | |
| 2002/0121543 | A1 | | 9/2002 | Simmons | |
| 2003/0205614 | A1 | * | 11/2003 | Klima et al. | 232/38 |
| 2003/0213837 | A1 | * | 11/2003 | Morgan | 232/38 |

* cited by examiner

*Primary Examiner*—William L. Miller
(74) *Attorney, Agent, or Firm*—Thomas E. Frantz

(57) ABSTRACT

A rural mailbox having a housing with a generally rectangular base member, a roof section positioned over the base member, and side sections depending downwardly from the roof section into engagement with the base member. A back panel is secured to one end of the base member and roof and side sections to close that end of the housing. A door is pivotally mounted on the other end of the housing for rotative movement between an open position exposing the interior of the housing and a closed position isolating the interior of the housing. The door is formed of a clear polycarbonate resin with smooth surfaces providing a transparent door through which any contents of the housing may be viewed from anywhere within a reasonable distance prior to opening the door for retrieval of any such contents while yet providing a door which is tough, strong, shatter resistant, resistant to distortion or other damage from environmental factors, and capable of many years of service.

11 Claims, 6 Drawing Sheets

52
54
70
11
34
68
58
66
52
60
20
12
16
54
38
50
20
18
22
11

70
54
52
68
58
66
60
34
20
12
16
38
54
50
18
22

MAILBOX

This application claims the benefit of U.S. Provisional Patent Application 60/381,050 filed May 17, 2002.

FIELD OF INVENTION

1. The present invention relates generally to rural type mailboxes of the type having a door which is manually rotatable between closed and open positions to deposit mail into and/or remove mail from the mailbox
2. More particularly, the invention relates to rural type mailboxes in which there is provision for viewing the interior of the mailbox prior to the act of opening its door, and to kits and procedures suitable for converting a prior art mailbox to one providing the safety, convenience and other unique features and advantages afforded by the present invention.

DESCRIPTION OF PRIOR ART

1. For many years, the usual rural type mailbox has caused certain inconveniences and safety concerns for mail carriers and rural residents who are required to use such mailboxes for the delivery and reception of U.S. mail. The mailboxes must be mounted relatively close to the road or highway at a certain minimum height to assure convenient delivery of mail by the mail carrier. In many cases, however, such proximity to the roadway makes it difficult if not actually dangerous for a resident, when turning into his or her driveway, to stop long enough to open the mailbox door and retrieve any mail which may be in the box. Rather the resident must proceed on into the driveway, park, exit the car, walk back to the mailbox and then open the door of the mailbox and inspect the interior for the presence of mail. Not only does this force the resident to stand dangerously close to the road or highway while opening, inspecting and retrieving mail, but many times such action must be taken during inclement weather.
2. Probably of even greater concern is the uncertainty which is now felt by both mail carriers and residents when opening the door of a rural type mailbox because of the rash of mailbox bombings which have occurred since 2002. As is well known, of course, the concern became so great at one point that the U.S. Postal Service ordered that for delivery to be made the door of all rural type mailboxes either had to be removed or left open. Even aside from the mailbox bombings, however, it has not been uncommon from time to time over the years for residents to find snakes, rats, rocks and other undesirable or obnoxious objects in their mailboxes.
3. Applicant finds a number of proposals in the prior art for possible solutions to the above discussed problems as they relate to the usual rural type mailbox. For example, U.S. Pat. Nos. 6,474,543 and 4,244,512 teach mailboxes with transparent covers through which mail as well as internally disposed pictures or other fanciful objects may be viewed by the mail carrier and resident. As far as is known, however, such prior art structure have not met with any consumer interest or commercial success. Not only would many residents object if others could easily see names, addresses and other information on mail placed in their mailboxes, but any picture or other decorative object mounted therein could severely obscure vision into the box for both the resident, carrier and any curious onlooker.
4. Other prior attempts to provide viewing windows for the convenience of the carrier and/or resident also have failed to resolve the above discussed problems. U.S. Pub. No. 2002/0121543 A1 illustrates a mailbox in which all sides are transparent, with mail being inserted and removed through a slide window 26. As with the two patents discussed immediately above, however, many residents would find a mailbox of this nature quite objectionable because of the lack of privacy it would engender.
5. Illustrative of other attempts to provide some means of visibility include:
   a) U.S. Pat. No. 3,107,848 shows a series of viewing holes along the sides of the box and a transparent rear wall which might make it somewhat easier for the resident to check for the presence of mail. It would not, however, resolve for the carrier, who normally does not have ready access to the back of the mailbox, the problem of a possible hidden bomb or other threat.
   b) U.S. Pat. No. 4,650,113, proposes transparent rearward sections 52 and 58, and U.S. Pat. No. 5,056,711 shows a transparent rearward window 5. Such rearwardly oriented transparent sections and windows might be considered under certain circumstances to provide more convenient viewing for the resident and/or any curious bystander, but not for the carrier.
   c) U.S. Pat. No. 2,561,007 shows a transparent receptacle 28 positioned below the main body of the mailbox, which receptacle is useful only to alert the carrier to the presence of mail to be picked up. This receptacle would be of no real value, however, in terms of warning either the carrier or the resident against any possible danger associated with movement of the door 10.
   d) U.S. Design Pat. No. D471,691 illustrates a rural type mailbox having along the bottom of each longitudinal side thereof a observational window. While observational windows of the type and location shown in this patent might be found useful to one approaching the mailbox from the side in determining the presence or absence of mail, it would not reliably indicate to either a carrier or resident approaching from the front or back thai the mailbox contained no harmful or obnoxious objects.
6. In contrast to all of the prior art discussed above, applicant's new and novel mailbox structure, whether newly manufactured or converted from a prior product, gives both the carrier and resident a clear and full view of the entire interior of the mailbox prior to any need to touch or open the mailbox's access door. At the same time, it preserves the resident's privacy since only one end (not the face) of any mail in the mailbox is exposed.

SUMMARY OF INVENTION

A. The general aim of the present invention is to provide significantly improved safety and convenience in the use of rural type mailboxes by carriers and residents.

B. Detailed objectives of the invention are:

1. To provide a rural type mailbox with a clear transparent access door through which, without loss of privacy, the entire interior of the mail box can be inspected quickly and conveniently by both the carrier and resident before any contact with the mailbox or any action to open the access door.
2. The provision of a kit of components by which the usual rural type mailbox can be converted easily and conveniently into a mailbox having a clear transparent access door through which, without loss of privacy, the entire interior of the mail box can be inspected quickly and conveniently by both the carrier and resident before any contact with the mailbox or any action to open the access door.

3. To provide a process by which a kit of components can be assembled with the usual rural type mailbox to easily and conveniently provide that mailbox with a clear transparent access door through which the entire interior of the mail box can be inspected quickly and conveniently without loss of privacy and before any contact with the mailbox or any action to open the access door.

4. To provide a rural type mailbox with a clear transparent access door formed of a long lasting polycarbonate resin having extreme toughness, strength, dimensional and physical stability, and resistance to weathering and other forms of stress or abuse.

C. These and other objectives and advantages of this invention will become more apparent from the following detailed description when taken in conjunction with the accompanying drawings.

BRIEF DESCRIPTION OF DRAWINGS

A.

B.

C.

D.

E.

F.

G.

H.

I.

J.

K.

L.

M.

N.

DETAILED DESCRIPTION

Figure 1:
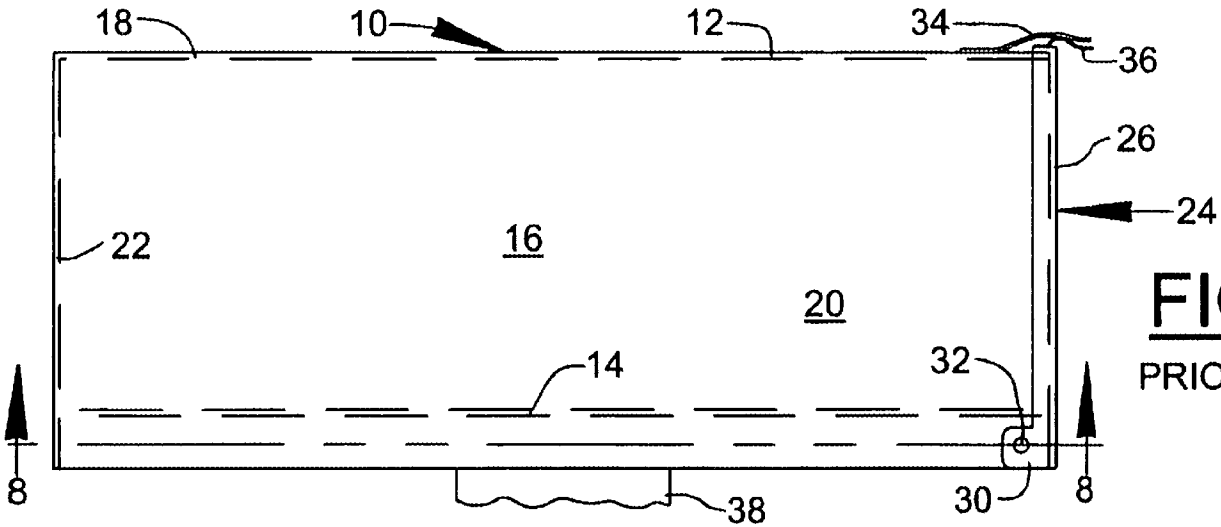
FIG. 1 PRIOR ART
FIG. 1 is side elevational view of the usual prior art mailbox of the type having an opaque metal door, showing the door closed.

Throughout this application, certain words are used for convenience only and are not to be construed as limiting. Additionally, in the drawings, like elements in the same or different embodiments or views may be identified with like reference numerals throughout the description. Also, where a particular element may be shown several times in the same drawing view, it may not be identified each time it is shown in that view, and all elements shown in one view of an embodiment may not be shown in all other views of that same embodiment.

Figure 2:
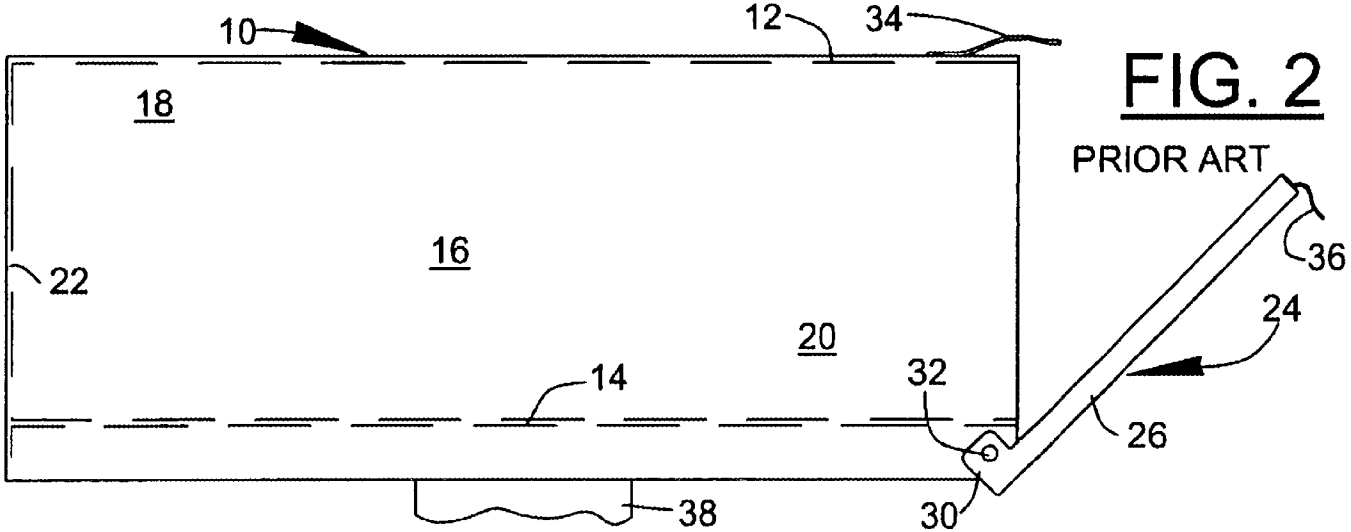
FIG. 2 PRIOR ART
FIG. 2 is a side elevational view of the prior art mailbox of FIG. 1, showing the door in a partially open position.

Referring now to the drawings and more particularly to FIGS. 1 and 2, the mailbox 10 represents a structure of the type approved by the U.S. Postal Service and used quite widely for a number of years throughout the rural areas of the country. The mailbox 10 includes a housing 12 preferably formed of an aluminum or enameled steel sheet, with a generally rectangular horizontally disposed base member 14 and cover member 16 positioned over the base member 14. Cover member 16 includes a generally semi-circular center section 18 terminating in side sections 20 depending therefrom and engaging base member 14. The back end of the housing 12 is closed by a back panel 22, the edges of which are crimped or otherwise attached to the rearward end of base member 14 and cover member 16.

Door 24 is pivotally mounted on the forward end of housing 12 for movement between the closed position illustrated in FIG. 1 and the open position illustrated in FIG. 2. As will be understood by those in the art, the outer periphery of front panel 26 is formed inwardly at about a 90 degree angle to provide flange 28 which is shaped and sized to substantially match and fit snugly over the forward open end of housing 12. Adjacent its lower ends, flange 28 is extended rearwardly a short distance to form hinge members 30 which are suitably drilled to provide circular supports 25 (see FIG. 10) for the reception therein of rivets 32 (see FIG. 14). Rivets 32, of course, act as hinge pins around which door 24 revolves as it is moved between its closed and open positions. Fixed to the top of housing 12 is an outwardly extending semi-resilient latch member 34 positioned to receive and frictionally hold clip 36 upon closure of door 24. As will be obvious from the drawings, this clip 36 will be found quite convenient in opening door 24. The mailbox 10 is mounted alongside a road or highway on a fixed post or like support member 38 which is attached to and extends downwardly from base member 14.

For many years, rural residents and mail carriers have experienced an occasional surprise in finding foreign objects, such as snakes, small rodents, bones and other like useless or obnoxious objects upon opening mailbox doors. Although perhaps inconvenient, such occurrences seldom have represented dangerous or life threatening situations. Within recent times, however, on a number of occasions, dangerous explosive devices have been concealed in rural mailboxes, some of which have exploded in response to movement of the mailbox door to insert or remove mail. As a result, for a period of time, the U.S. Postal Service required that the doors of all rural type mailboxes either had to be left open or totally removed to eliminate the need for carriers to open such doors before depositing mail in or removing mail from those mailboxes. Obviously, an open or missing mailbox door presents a most undesirable situation because of the danger of mail becoming water soaked or even blown from the mailbox during a heavy rain or windy storm.

By the present invention, applicant has provided a simple yet new, unique, non-obvious, convenient, and inexpensive solution for these problems.

Calling attention now to FIGS. 3 and 4, there is shown a mailbox 50 having the same type of housing 12 as described hereinabove in connection with the prior art mailbox 10. As earlier described, housing 12 preferably is formed of an aluminum or enameled steel sheet having good weathering properties, and comprises a generally rectangular base member 14 and cover member 16. Cover member 16 includes a generally semi-circular center section 18 having side sections 20 depending therefrom into engagement with base member 14, with the back of housing 12 being closed by back panel 22. Attached to and extending downwardly from base member 14 is support post or other like support member 38.

Figure 3:
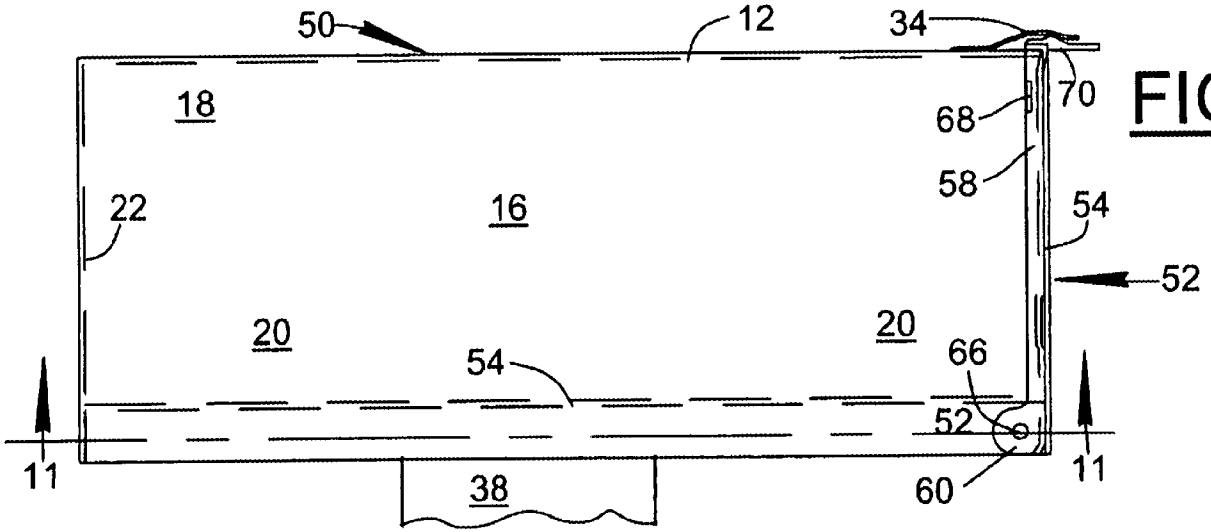
FIG. 3 is a side elevation view of a mailbox assembly according to a preferred embodiment of the present invention, showing the access door in a closed position.
Figure 4:
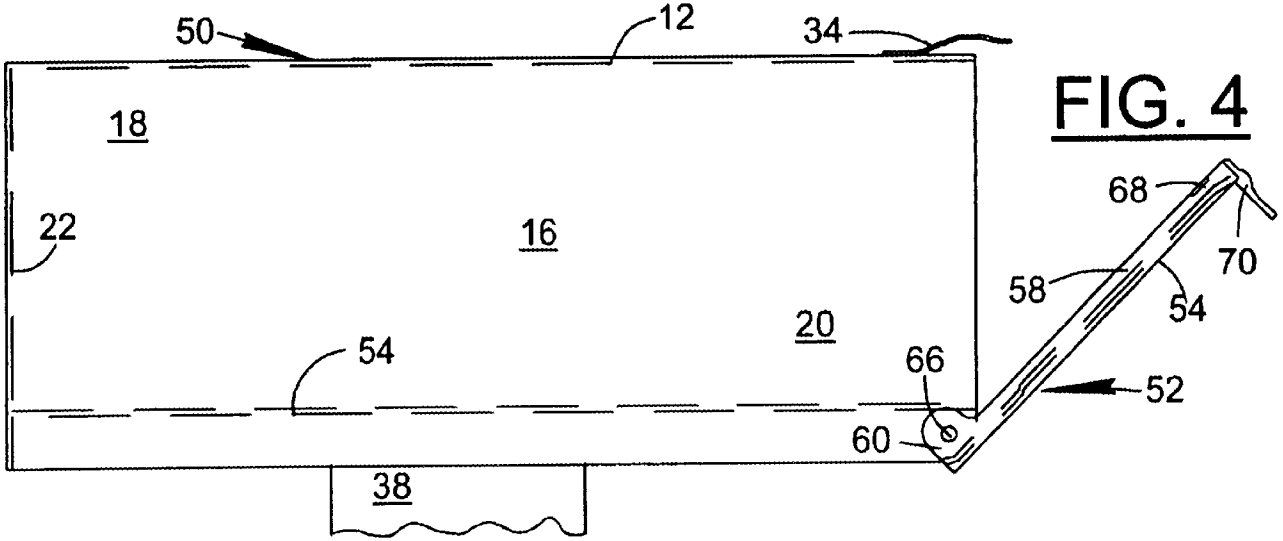
FIG. 4 is a side elevational view of the mailbox assembly according to FIG. 3, showing the access door in a partially open position.
Figure 7:
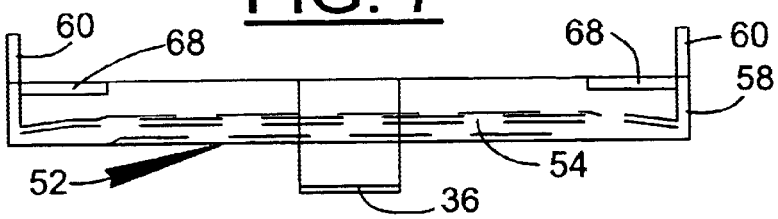
FIG. 7 is an enlarged top elevational view of the access door of the embodiment of FIG. 3.
Figure 5:
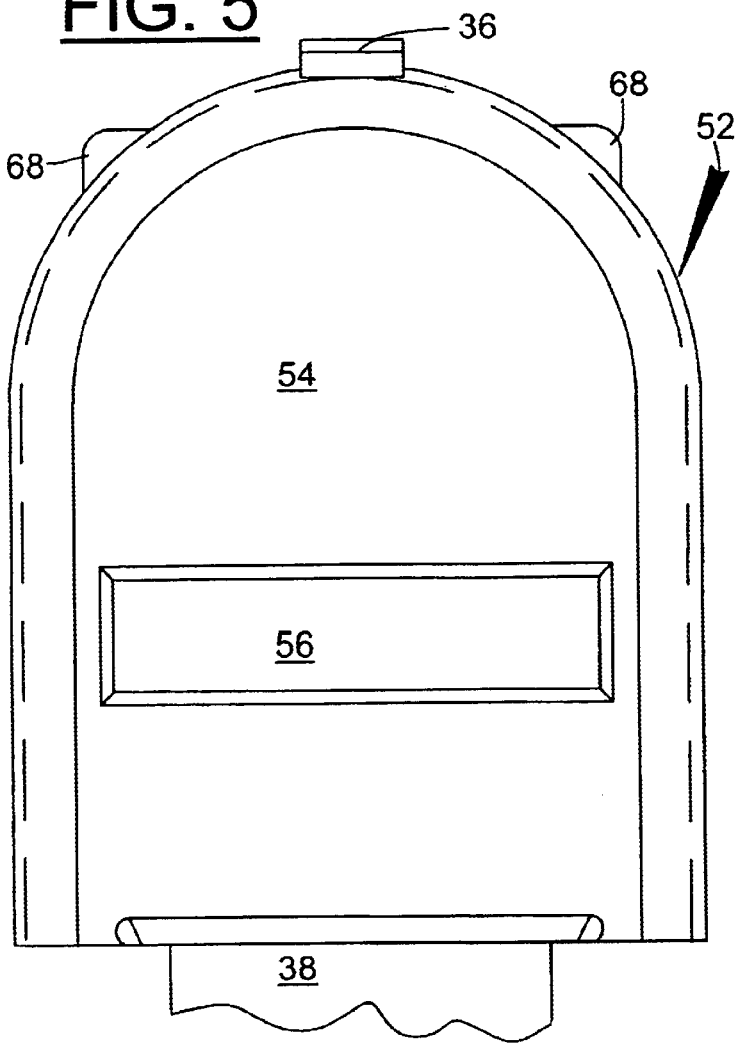
FIG. 5 is an enlarged front elevational view of the access door of the embodiment of FIG. 3.
Figure 6:
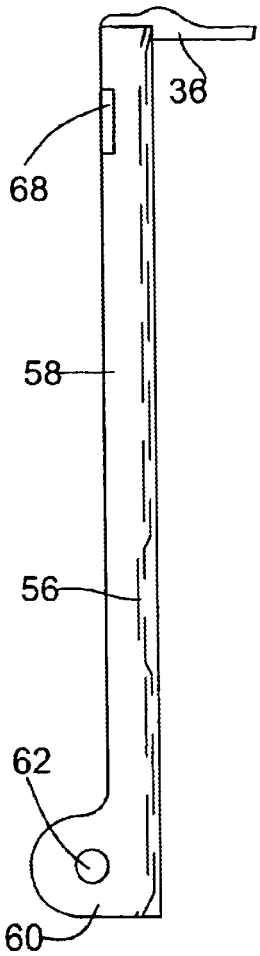
FIG. 6 is an enlarged side elevational view of the access door of the embodiment of FIG. 3.

Pivotally mounted on the forward end of housing 12 for movement between the closed position illustrated in FIG. 3 and the open position illustrated in FIG. 4 is a clear transparent access door 52 formed and mounted according to the present invention. More particularly, access door 52 includes a front panel 54 having a recessed area 56, with the outer periphery of the front panel 54 carrying a flange 58 which extends inwardly at about a 90 degree angle and which is shaped and sized to fit snugly over the forward open end of housing 12. Adjacent its lower ends, flange 58 is extended rearwardly a short distance to form hinge members 60 which are suitably provided with apertures 62 (see FIG. 6) for the reception therein of a pivot rod 64 around which access door 52 rotates during moment between its closed and open positions. When in its closed position, access door 52 is releasable held against inadvertent movement by frictional engagement between outwardly extending catch 70 and latch member 34. Access door 52 can be opened conveniently by use of catch 70 or by either of the two finger tabs 68 provided by flange 58.

Figure 13:
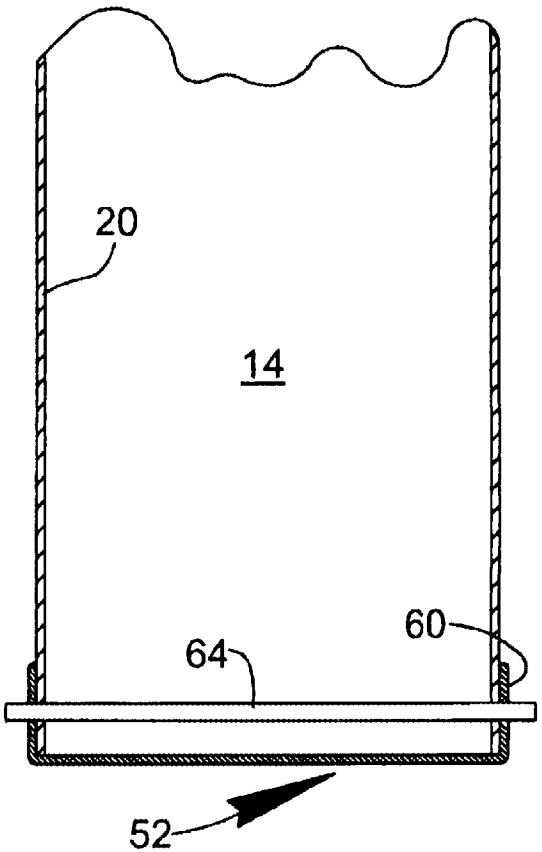
FIG. 13 is a cross-sectional view taken substantially along the line 11—11 of FIG. 3, showing the pivot shaft fully inserted through the axially aligned apertures in the access door and housing, with the access door positioned on the housing in a closed position.
Figure 12:
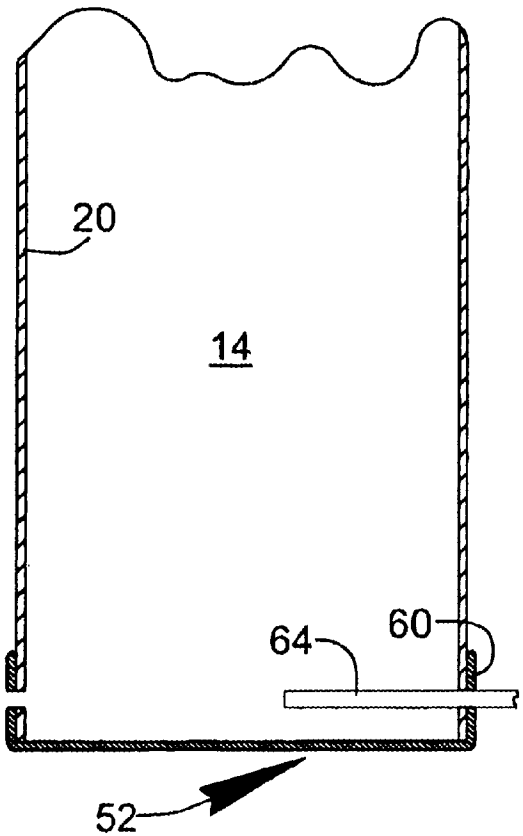
FIG. 12 is a cross-sectional view taken substantially along the line 11—11 of FIG. 3 showing the pivot shaft partially inserted through the axially aligned apertures in the access door and housing, with the access door positioned on the housing in a closed position.

As will be noted best from FIGS. 12 and 13, pivot rod 64 is somewhat longer than the total width between the outer surface of hinge members 60, and when properly placed extends a short distance beyond such outer surfaces. Attached to these exposed ends are push-on speed nut type end caps 66 which serve to hold pivot rod 64 against inadvertent movement or loss.

Access door 52 can be molded of any of several polycarbon resins, of which a resin produced and sold by the General Electric company under the name Polymerland AVP TLL80 has been found to be quite satisfactory. This is a very strong, tough plastic material exhibiting an exceptional combination of clarity, heat and impact resistance, and resistance to distortion, discoloration or other degradation upon long exposure to sunlight and severe outdoor environments. While this type of polycarbon resin is naturally clear and transparent and in many applications quite acceptable after being formed using normal molding dies and techniques, for the present use it is preferred that the dies for door 52 be polished to a relatively high degree to assure that the finished product has very smooth glass-like surfaces. In this connection, it will be understood that the smoother the surfaces of the molded door the greater its transparency and clarity will be. In the molding trade, the smoothness of interior die surfaces are commonly graded on a scale of one to five (five being the smoothest) with the dies used for door 52 preferably being in the range of grade 4.

From the above discussion it will be clear to those in the art that the present invention is fully applicable to and useful with rural type mailboxes whether now in use or manufactured for use in the future. Particularly for use with currently employed mailboxes having the usual opaque metal door, this invention provides a kit of and a process for installing the components needed to convert such older mailboxes to mailboxes having the features, conveniences and advantages provided by this invention.

A kit of the nature mentioned above is comprised of a completely finished access door 52, a pivot rod 64 and a pair of end caps 66 along with instructions for carrying out the steps necessary to remove the original opaque door of a rural type mailbox and to install the new transparent polycarbon access door using the pivot rod 64 and end caps 66 as supplied in the kit.

Figure 10:
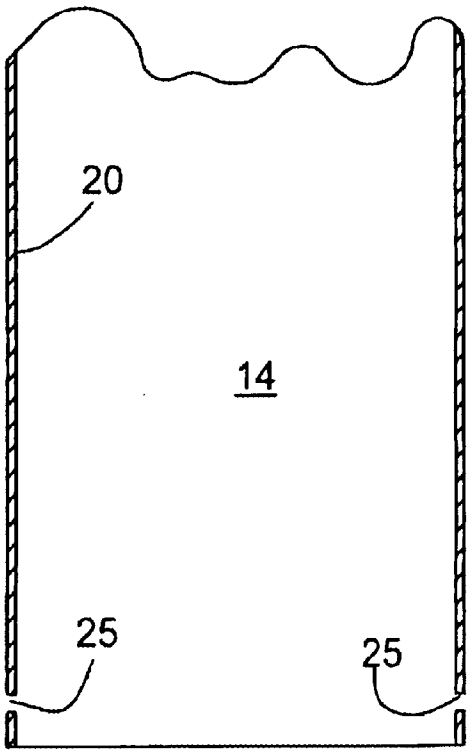
FIG. 10 PRIOR ART
FIG. 10 is a cross-sectional view taken substantially along the line 8—8 of FIG. 1, showing the housing of the mailbox after removal of the prior art door and rivets.
Figure 9:
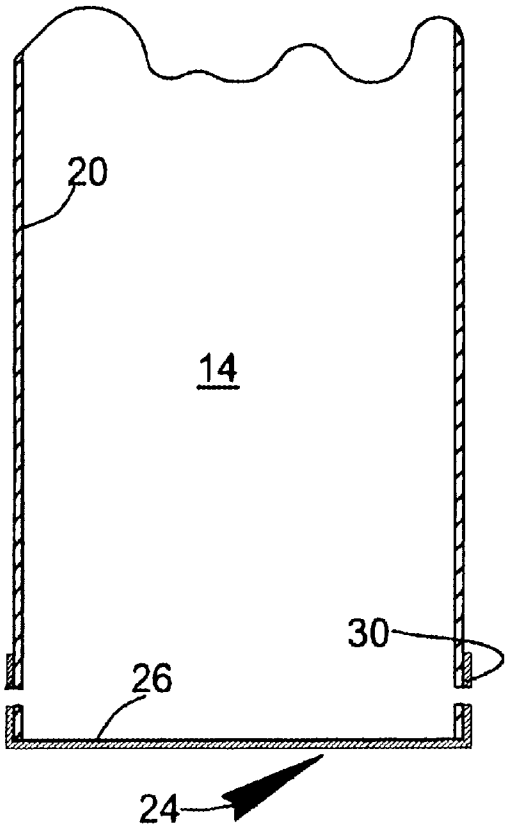
FIG. 9 PRIOR ART
FIG. 9 is a cross-sectional view taken substantially along the line 8—8 of FIG. 1, showing the prior art door closed after removal of the rivets.
Figure 8:
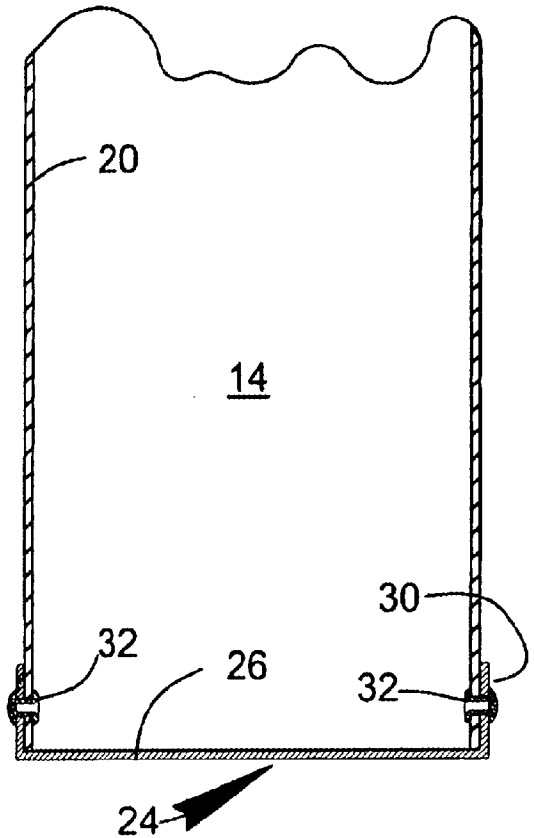
FIG. 8 PRIOR ART
FIG. 8 is a cross-sectional view taken substantially along the line 8—8 of FIG. 1, showing the prior art door closed and the rivets used in pivotally mounting the door on the housing of the mailbox..
Figure 11:
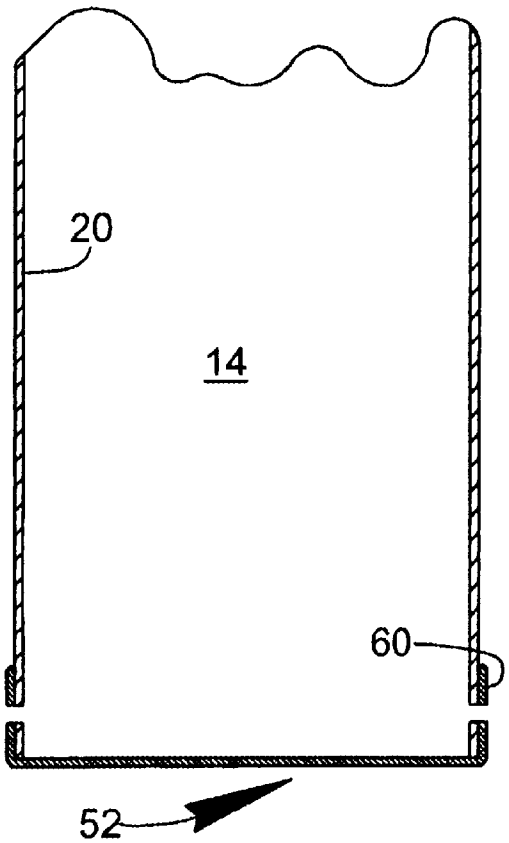
FIG. 11 is a cross-sectional view taken substantially along the line 11—11 of FIG. 3 showing the access door according to the present invention positioned on the housing in a closed position.
Figure 14:
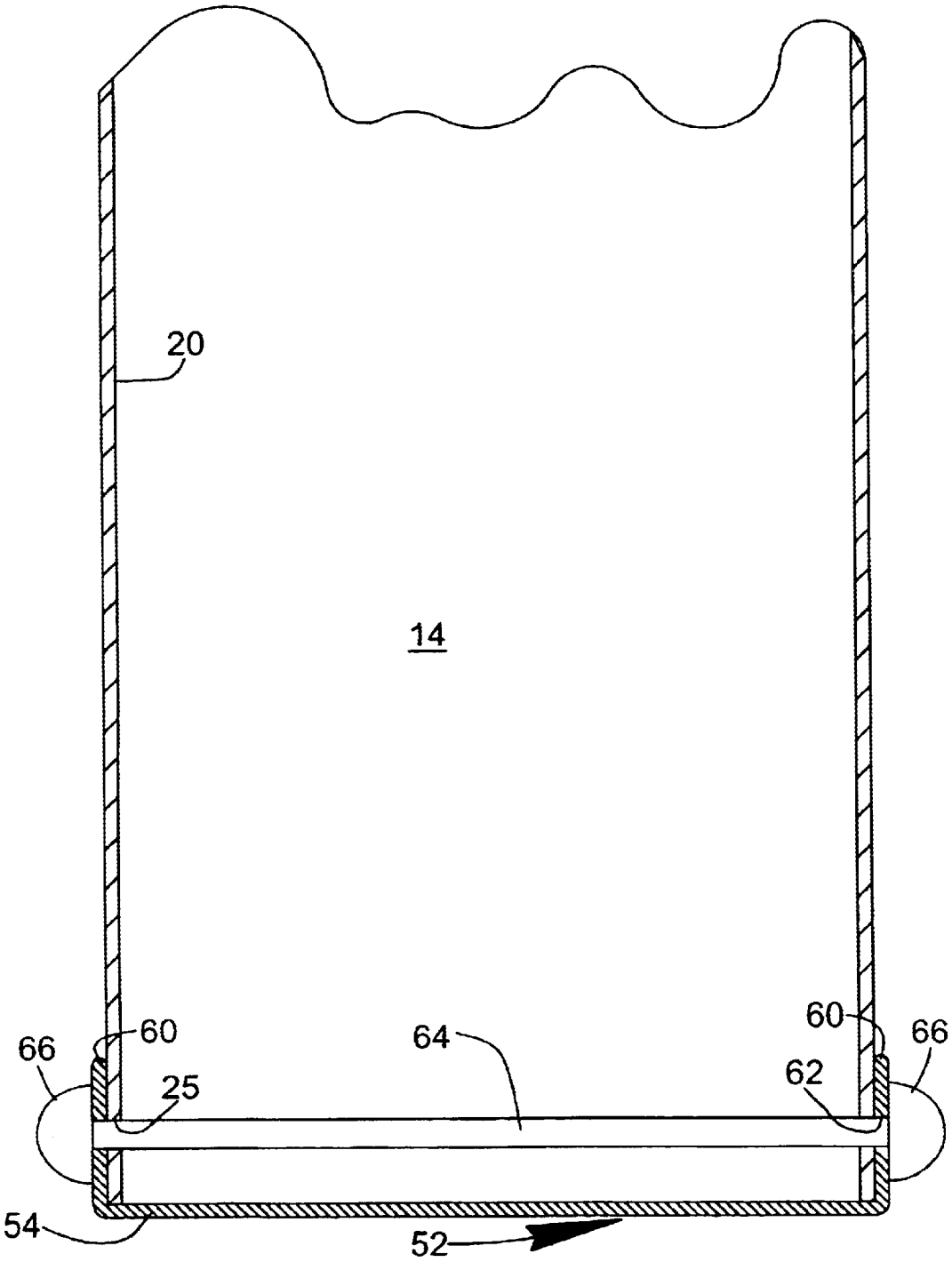
FIG. 14 is an enlarged cross-sectional view taken substantially along the line 11—11 of FIG. 3, showing the pivot shaft fully inserted through the axially aligned apertures in the access door and housing, and with locking members positioned on the exposed ends of the pivot shaft.

To illustrate this process, attention is called to FIGS. 8 through 14 representing the following steps:

1. FIG. 8—position and inspect the bottom of the mailbox for the following steps.
2. FIG. 9—remove by drilling or other convenient process the rivets 32 or other like fasteners used by the original manufacturer to assemble door 24 and housing 12.
3. FIG. 10—remove the original door 24 from housing 12.
4. FIG. 11—assemble the new transparent access door 52 and housing 12 while positioning supports 25 and apertures 62 in axial alignment with one another.
5. FIG. 12—insert pivot rod 64 through aligned supports 25 and apertures 62.
6. FIG. 13—complete insertion of pivot rod 64 with its ends evenly projecting beyond hinge members 60.
7. FIG. 14—press an end cap 66 over each projecting end of pivot rod 64 and into light engagement with the outer surfaces of hinge members 60 to stabilize the position of pivot rod 64 and thus assure continued function of access door 54 and housing 12.

SUMMARY

From the foregoing, it will be apparent that the present invention brings to the art a new, novel, and inexpensive yet greatly improved mailbox which, by virtue of its use of a clear transparent access door formed of a polycarbonate resin, effectively resolves the above discussed safety problems inherent in the usual rural type mailbox heretofore available for use in rural areas. The invention also brings to the art a kit of components and procedures for using such components for converting formerly unsafe mailboxes into mailboxes having all of the features and advantages provided by this invention. The polycarbonate resin selected for use herein provides very high performance properties, excellent strength, clarity, and resistance to degradation or damage because of long exposure to sunlight and other environmental influences.

Obviously, many modifications and variations of the present invention are possible in light of the teachings in this applications. For instance, in the embodiment illustrated in FIG. 14, the externally mounted end caps 66 could be replaced readily by clamps attachable to pivot rod 64 between the inner surfaces of the side sections 20. Or through normal testing and evaluation, one might be successful in locating a polycarbonate brand or variety of resin equal in its important specifications to the brand and type specified hereabove for use in molding the access door 52. Also, of course, this invention is not limited to mailboxes of the type having a housing with a semi-circular top section, as the shape and dimensions of access door 52 are readily changed to accommodate rural type mailboxes with other basic shapes and dimensions.

Thus, the foregoing description and drawings of a preferred embodiment of the invention have been presented for the purpose of illustration only and are neither intended nor desired to be exhaustive or in any way to limit the invention to the form disclosed. Accordingly, it is not intended that the scope of this invention be limited by the foregoing.

Having thus described and illustrated certain features and embodiments of the invention, what is claimed as new and novel and desired to be protected by letters patent is as follows:

I claim:

1. A kit for use in converting a traditional rural mailbox having a housing with an open end and aligned supports pivotally mounting an opaque door for movement between positions opening and closing the open end, into a mailbox with a transparent replacement access door through which any content within the housing may safely be viewed from a distance and without opening the door, the kit comprising said transparent replacement access door, a pivot member for mounting said access door for pivotal movement around the aligned supports between a position closing the open end and a position spaced from the open end, said access door being formed of a clear polycarbonate resin and provided with a front panel substantially coextensive in size and configuration with the open end of the housing and providing an integral peripheral flange positioned and sized to snugly engage and close the open end of the housing upon movement of said access door to its said closed position, and locking means engagable with said pivot member for maintaining said member in operative engagement with said access door and aligned supports after conversion of the mailbox with the kit.

2. A conversion kit according to claim 1 wherein said peripheral flange provides axially aligned apertures positioned for alignment with said supports, said pivot member comprises a cylindrical pivot rod of a length sufficient to extend through said aligned apertures and supports, said locking means comprises locking members adapted for placement on the ends of the pivot rod externally of said flange, and a manually accessible catch extends outwardly from said flange generally transversely of said front panel.

3. A conversion kit according to claim 2 wherein extensions are provided on opposed sides of said peripheral flange proximate its lower end, said axially aligned apertures are formed in said extensions and sized to receive said pivot rod, said rod is of such length as to extend through and beyond said aligned supports and apertures, said locking members comprise a pair of speed-nut end caps engagable with the ends of said pivot rod to maintain said pivot rod centered relative to said supports and apertures after conversion of the mailbox with the kit.

4. A conversion kit according to claim 3 wherein said manually accessible catch is formed integral with and positioned substantially at the top of said flange, and a pair of manually accessible outwardly extending tabs are formed integral with said flange and positioned in a spaced relationship with one another and with said catch.

5. A process whereby a traditional rural mailbox having a housing with an open end and aligned supports containing elements pivotally mounting an opaque door for movement between positions opening and closing the open end is converted into a mailbox with a transparent access door through which any content within the housing may safely be viewed from a distance and without opening the door, said process comprising the steps of removing the elements pivotally mounting the opaque door on the housing supports, removing the opaque door from the housing, providing said door formed of a clear transparent polycarbonate resin and provided with a flange having hinge members with aligned apertures spaced to receive the open end of the housing, positioning said access door on the open end of the housing with said apertures disposed in alignment with the housing supports, inserting a pivot rod into and through said aligned housing supports and apertures, and positioning locking means on said pivot rod to maintain said rod in operative engagement with said aligned supports and apertures after conversion of the mailbox.

6. A process according to claim 5, characterized by the further steps of positioning said pivot rod so that its ends extend substantially equally beyond the outer surface of said hinge members, and pressing a speed-nut end cap over each exposed end of said pivot rod and into engagement with said outer surfaces of said hinge members to maintain said pivot rod in operative engagement with said aligned supports and apertures after conversion of the mailbox.

7. A rural mailbox comprising a housing having an open end and axially aligned supports proximate such open end, a clear transparent access door a pivot member extending through the supports and mounting said access door for rotation around such supports between positions opening and closing the open end, said access door being provided with a front panel substantially coextensive in size and configuration with the open end of the housing, and having an integral peripheral flange positioned and sized to snugly engage and close the open end when said access door is disposed in its closed position, and locking means engagable with said pivot member for maintaining said member in operative engagement with said access door and aligned supports, said locking means comprising end caps disposed on the exposed ends of said pivot member.

8. A mailbox according to claim 7 characterized by a latch fixed on and extending outwardly from the housing, a manually accessible catch integral with and extending outwardly from said flange generally transversely of said front panel, said catch being positioned for frictional engagement with said housing upon movement of said access door to its closed position to releasably retain said access door in such position, said peripheral flange being formed with aligned apertures positioned in alignment with the supports, said pivot member extending through and beyond said apertures and supports to journal said access door for rotation between its said open and closed positions.

9. A mailbox according to claim 8 characterized by extensions being provided on opposed sides of said peripheral flange proximate its lower end, said axially aligned apertures being formed in said extensions and sized to receive said pivot member, said pivot member comprising an cylindrical rod of such length as to extend through and beyond said aligned supports and apertures, and said locking means comprising a pair of speed-nut end caps engageable with the ends of said rod to maintain said rod centered relative to said supports and apertures.

10. A mailbox according to claim 9 characterized by said catch being positioned centrally of the top surface of said door, and a pair of tabs integral with and projecting outwardly from said flange, said tabs being spaced apart on opposite sides of said catch and positioned for use in manually moving said door between its said open and closed positions.

11. A mail box according to claim 7 characterized by said access door being formed of a polycarbonate resin with non-waviness surfaces of high smoothness capable of providing high clarity.

* * * * *